US009222154B2

(12) United States Patent
Dolman

(10) Patent No.: US 9,222,154 B2
(45) Date of Patent: Dec. 29, 2015

(54) WEAR RESISTANT CAST IRON

(75) Inventor: Kevin Francis Dolman, Epping (AU)

(73) Assignee: Weir Minerals Australia Ltd., Artarmon, New South Wales (AU)

( * ) Notice: Subject to any disclaimer, the term of this patent is extended or adjusted under 35 U.S.C. 154(b) by 544 days.

(21) Appl. No.: 10/557,509

(22) PCT Filed: May 21, 2004

(86) PCT No.: PCT/AU2004/000678
§ 371 (c)(1),
(2), (4) Date: Dec. 13, 2006

(87) PCT Pub. No.: WO2004/104253
PCT Pub. Date: Dec. 2, 2004

(65) Prior Publication Data

US 2007/0095443 A1 May 3, 2007

(30) Foreign Application Priority Data

May 22, 2003 (AU) ..... 2003902535

(51) Int. Cl.

| | |
|---|---|
| ***C22C 37/06*** | (2006.01) |
| ***C22C 37/08*** | (2006.01) |
| ***C22C 37/10*** | (2006.01) |
| ***C21D 5/04*** | (2006.01) |

(52) U.S. Cl.
CPC . *C22C 37/06* (2013.01); *C21D 5/04* (2013.01); *C22C 37/08* (2013.01); *C22C 37/10* (2013.01); *C21D 2211/003* (2013.01); *C21D 2211/004* (2013.01); *C21D 2211/008* (2013.01)

(58) Field of Classification Search
CPC ..... C22C 37/06; C22C 37/10; C22C 37/08; C21D 5/04; C21D 2211/008; C21D 2211/003; C21D 2211/004
USPC ..... 148/320, 321, 324, 325, 542, 543; 420/11, 13, 15, 34
See application file for complete search history.

(56) References Cited

FOREIGN PATENT DOCUMENTS

| | | | | |
|---|---|---|---|---|
| CA | 984185 | A | | 2/1976 |
| CN | 1202531 | A | | 12/1998 |
| DE | 94263 | A | | 5/1972 |
| DE | 2504483 | A1 | | 8/1976 |
| EP | 0014655 | A | | 8/1980 |
| EP | 0014655 | B1 | | 8/1980 |
| GB | 1 343 013 | A | | 1/1974 |
| JP | 51061422 | A | | 5/1976 |
| JP | 54065116 | A | * | 5/1979 |
| JP | 57089453 | A | | 3/1982 |
| JP | 63121635 | A | | 5/1988 |
| SU | 663748 | | | 5/1970 |
| SU | 298682 | | | 8/1972 |
| SU | 1359329 | | | 12/1987 |
| SU | 1735425 | A | | 5/1992 |
| SU | 1765236 | A | | 9/1992 |
| WO | WO 8404760 | A1 | * | 12/1984 |

OTHER PUBLICATIONS

Isaki et al., English translation of JP 54-065116, May 25, 1979, p. 1-6.*
Tembe et al., English machine translation of DE2504483, Aug. 5, 1976, p. 1-5.*

* cited by examiner

*Primary Examiner* — Roy King
*Assistant Examiner* — Caitlin Kiechle
(74) *Attorney, Agent, or Firm* — Jones Day

(57) ABSTRACT

A casting of a white cast iron alloy which includes the following alloy composition, in weight %:
- chromium: 12-25%;
- carbon: 1.5-6%;
- manganese: 2-7%;
- silicon: up to 1.5%;
- molybdenum: up to 2;
- nickel: up to 4%;
- microalloying elements selected from the group of titanium, zirconium, niobium, boron, vanadium, and tungsten: up to 2% of each of one or more of the elements; and
- iron: balance.

The microstructure of the casting has 15-60 vol % eutectic carbides and primary carbides dispersed in a ferrous matrix of martensite and is at least substantially free of pearlite.

19 Claims, 4 Drawing Sheets

WEAR RESISTANT CAST IRON

The present invention relates to white cast iron alloys for high erosion and high abrasion applications and to a method of producing castings of white cast iron alloys.

BACKGROUND

The components of most mining and processing equipment that are subject to wear (eg slurry pumps, cyclones and crushers) are produced from wear resistant white cast iron alloys.

Castings of these white cast iron alloys have high wear resistance and provide good service life for process equipment that is subject to erosion and abrasion wear.

Australian Standard 2027 describes inter alia the following two families of wear resistant white cast iron alloys:

(a) high chromium white cast iron alloy, eg 27% Cr; and (b) chromium-molybdenum white cast iron alloy, eg 20Cr-2Mo and 15Cr-3Mo.

The microstructures of all these white cast iron alloys consist of two phases, namely:

(a) $M_7C_3$ carbides (where M=Fe, Cr, Mn, Mo), which have a hardness of 1200-1500 HV; and (b) ferrous matrix that consists of one or more of the following structures (i) a saturated solution of austenite which is metastable at room temperature, (ii) solute-depleted austenite containing secondary carbide precipitates and is destabilised at room temperature (iii) destabilised, retained austenite partially transformed to martensite and (iv) destabilised, retained austenite wholly transformed to martensite.

The wear resistance of these white cast iron alloys is due to (a) the presence of the extremely hard $M_7C_3$ carbides and (b) the presence of a hard martensitic structure in the ferrous matrix.

It is essential to avoid the formation of pearlite in the ferrous matrix in these alloys during cooling after heat treatment in order to ensure adequate wear resistance in service.

It is a common practice to subject white cast iron alloys to an intermediate annealing process to deliberately form pearlite in order to soften the alloy for machining purposes. However, the machined white cast iron alloys are then subjected to a final heat treatment process to harden the alloys prior to service.

The ferrous matrix of AS2027, Grade 27% Cr (high chromium) white cast iron alloys can be readily hardened by forming martensite in the ferrous matrix during air cooling after heat treatment. One of the functions of the chromium in the alloys is to suppress the formation of pearlite during cooling from elevated temperatures.

However, white cast iron alloys containing lower chromium contents, eg 20Cr-2Mo and 15Cr-3Mo, require the addition of molybdenum and/or nickel to suppress the formation of pearlite on cooling after heat treatment, particularly in heavy section castings, ie castings greater than 10 cm thick. However, molybdenum and nickel are each expensive alloying elements and add substantially to the material cost of white cast iron alloys.

SUMMARY

An object of the present invention is to provide a white cast iron alloy that is a lower cost alternative to the currently available white cast iron alloys described above.

The present invention is based on the realisation that it is possible to produce a white cast iron alloy that can produce castings that have at least comparable wear resistance to castings of currently available white cast iron alloys at considerably lower cost by substituting manganese for at least some of the molybdenum, nickel, and chromium in the currently available white cast iron alloys.

DETAILED DESCRIPTION

Figure 1:
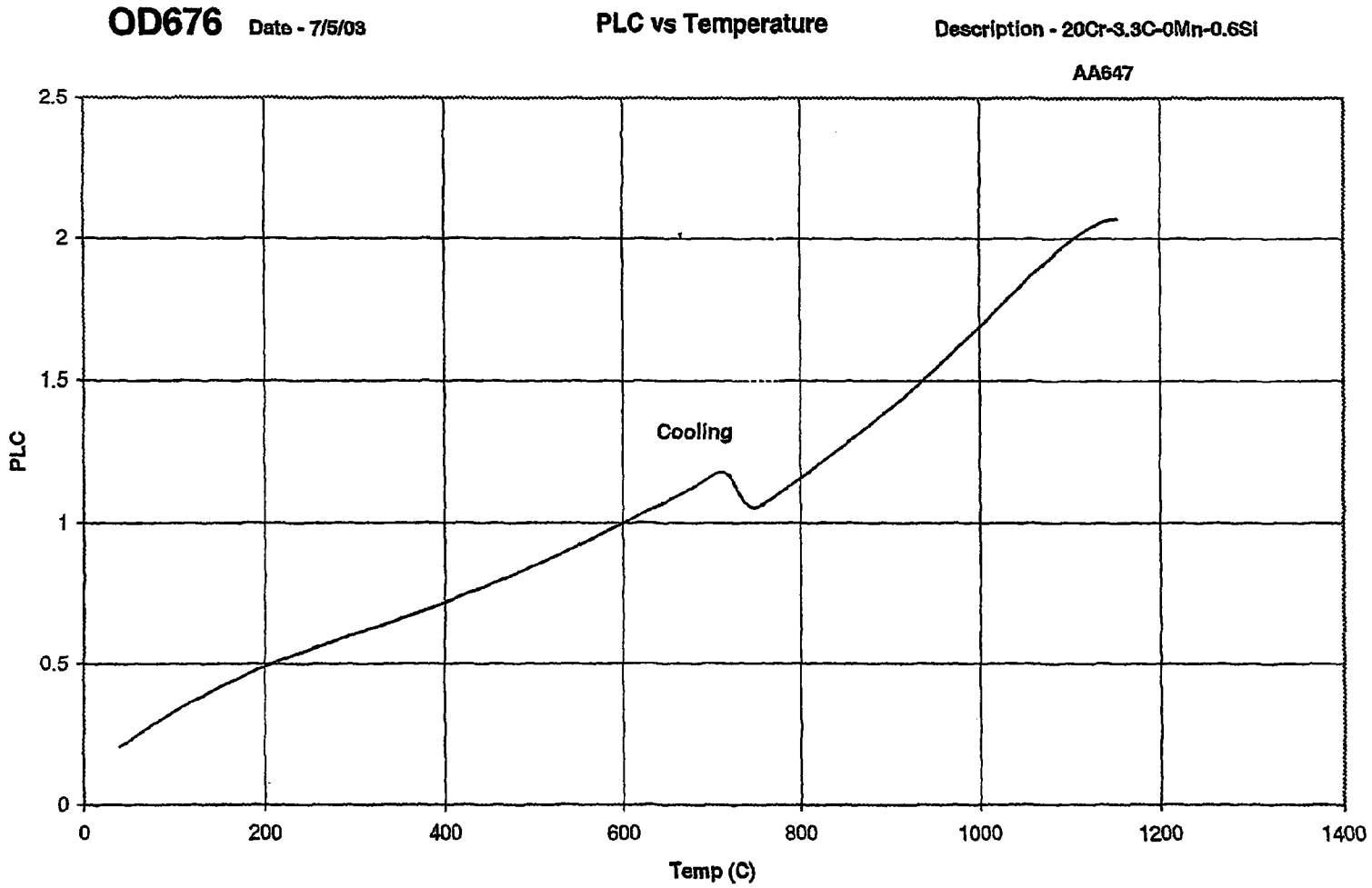
FIG. 1 is dilatometer curve which illustrates the contraction characteristics of the base alloy (ie alloy with no molybdenum and no manganese) during furnace cooling from 1150° C.

According to the present invention there is provided a casting of a white cast iron alloy that comprises the following alloy composition, in weight %:

chromium: 12-25%;
carbon: 1.5-6%;
manganese: 2-7%;
silicon: up to 1.5%;
molybdenum: up to 2;
nickel: up to 4%;
microalloying elements selected from the group consisting of titanium, zirconium, niobium, boron, vanadium, and tungsten: up to 2% of each of one or more of the elements; and
iron: balance.

According to the present invention there is also provided a casting of a white cast iron alloy that comprises:

(a) the following alloy composition, in wt %:
chromium: 12-25%;
carbon: 1.5-6%;
manganese: 2-7%;
silicon: up to 1.5%;
molybdenum: up to 2;
nickel: up to 4;
microalloying elements selected from the group consisting of titanium, zirconium, niobium, boron, vanadium, and tungsten: up to 2% of each of one or more of the elements; and
iron: balance; and (b) a microstructure that comprises 15-60 volume % eutectic carbides and primary carbides dispersed in a ferrous matrix that comprises martensite and is at least substantially free of pearlite.

The term "at least substantially free of pearlite" indicates that the objective of the present invention is that there be no pearlite in the matrix but at the same time recognises that in any given situation in practice there may be a small amount of pearlite.

With the above in mind, the term "substantially free of pearlite" is understood herein to mean that the casting contains no more than 2 volume % pearlite.

Preferably the white cast iron alloy comprises 15-23 weight % chromium.

As indicated above, chromium suppresses pearlite formation and, therefore, as the chromium concentration within the stated range of 12-25 weight % in the white cast iron decreases it is necessary to increase the concentrations of manganese (or other additives) to counteract the higher susceptibility to pearlite formation at lower concentrations of chromium. One advantage of using lower concentrations of chromium is that lower chromium concentrations increase the instability of austenite. This results in an increase in the amount of the desirable hard martensite phase in the white cast iron.

Preferably the white cast iron alloy comprises 2.5-6 weight % manganese.

The applicant has found that as the concentration of manganese increases, the temperature at which the retained austenite starts to transform to martensite (Ms temperature) on cooling from the precipitation hardening temperature decreases. At manganese concentrations above 6 weight % manganese, the martensite start temperature may be below room temperature and thus the matrix may be predominantly retained austenite. Accordingly, for applications requiring high hardness, it is preferred that the manganese concentration be no more than 6 weight %.

More preferably the white cast iron alloy comprises 2.5-5.5 weight % manganese.

It is preferred particularly that the white cast iron alloy comprises 3.5-5.5 weight % manganese.

Preferably the white cast iron comprises up to 1.5 weight % silicon.

Preferably the white cast iron comprises no nickel and molybdenum.

However, it is within the scope of the present invention for the white cast iron to include molybdenum and nickel up to the stated maximums of 2 and 4 weight %, respectively.

Preferably the ferrous matrix comprises martensite and retained austenite.

Preferably the eutectic carbides, and primary carbides comprise $M_7C_3$ carbides, where "M" is a metal and "C" is carbon.

According to the present invention there is also provided a method of producing the above-described casting of the white cast iron alloy which comprises the steps of:

(a) forming a molten melt of the above-described white cast iron alloy;

(b) pouring the molten melt into a mould to form the casting;

(c) allowing the casting to air cool to room temperature.

The method produces a casting having a microstructure that comprises 15-60 volume % eutectic carbides and primary carbides dispersed in a ferrous matrix that comprises martensite and retained austenite and is at least substantially free of pearlite.

Preferably the method further comprises heat treating the room temperature casting by:

(a) heating the casting to an elevated temperature where austenite decomposes to form secondary carbide precipitates in a solute-depleted austenite; and thereafter (b) air cooling the casting to room temperature and transforming the solute-depleted austenite to martensite.

Preferably the austenite-destabilising temperature is in the range of 950-1000° C.

Preferably step (a) includes holding the casting at the austenite-destabilising temperature for at least 4 hours to ensure substantial secondary carbide precipitation has occurred.

The present invention is described further by reference to the following experimental work which was carried out for the purpose of comparing the performance of castings of white cast iron alloys in accordance with the present invention against the performance of castings of currently available white cast iron alloys.

EXPERIMENTAL PROGRAM

A number of white cast iron alloys containing systematic variations in chromium, molybdenum and manganese levels from a base alloy composition (Fe-20Cr-3.3C-0.6Si (weight %)) were manufactured in an electric arc melting furnace under an inert atmosphere. The alloys were then processed as described below and the resultant samples were evaluated using the following test procedures:

| Test Procedure | Purpose |
|---|---|
| Dilatometry | Phase changes that occur during cooling of white cast iron alloys are often accompanied by changes in the contraction of the alloys as a function of temperature. |
| Metallography | The presence of pearlite and other phases are readily detected by microstructural examination. |
| Hardness testing | Different phases in white cast iron alloys exhibit a range of hardness values. |
| Ferrite content | The magnetic response of white cast iron alloys is an indication of the presence of various phases. |

SUMMARY OF TEST RESULTS

A first series of pin samples of the base alloy (Fe-20Cr-3.3C-0.6Si (weight %)) and the variations of the base alloy were heated in a dilatometer to 1150° C., held for one hour to ensure equilibrium, and furnace cooled to obtain contraction cooling curves.

The above test procedure closely simulates the cooling rate of castings in a sand mould after solidification. Accordingly, the samples have properties and microstructures that are representative of properties and microstructures of as-cast castings.

The pin samples were subjected to hardness testing, ferrite content and metallographic examination.

A summary of the metallographic, hardness, and ferrite test results for each alloy is set out in Table 1 below.

TABLE 1

Summary of Test Results

| Alloy (Wt %) | Test No | Hardness (HV 50) | Ferrite (%) | Microstructure |
|---|---|---|---|---|
| Base alloy + 2Mn + 2Mo | OD674 | 766 | 32 | No Pearlite |
| Base alloy (no Mn/Mo) | OD676 | 380 | 49 | Pearlite |
| Base alloy + 1Mn | OD677 | 420 | 47 | Pearlite |
| Base alloy + 2Mn | OD673 | 533 | 40 | Pearlite |
| Base alloy + 3Mn | OD681 | 719 | 33 | Trace of pearlite |
| Base alloy + 4Mn | OD675 | 700 | 24 | No Pearlite |

The test results for four of the above alloys (OD676, OD674, OD675, and OD681) are discussed further below, particularly in the context of the dilatometry results.

Base Alloy (OD676)—No Mo/Mn

The contraction characteristics of the base alloy (ie alloy with no molybdenum and no manganese) during furnace cooling from 1150° C. is illustrated in the dilatometer curve of FIG. 1.

The total percent linear contraction (PLC) is about 2.1% on cooling through the temperature range. There is a sharp discontinuity in the cooling curve at a temperature of about 700° C. indicating the formation of undesirable pearlite at that temperature.

Final Hardness=380 HV50 due to the presence of the soft ferrite phase in the pearlite.

Ferrite Content=49% due to complete transformation of the high temperature austenite phase to body-centred-cubic ferrite which is ferromagnetic and absence of any retained face-centred-cubic austenite which is paramagnetic.

Metallographic examination demonstrated the presence of pearlite throughout the microstructure.

Base Alloy+2Mn+2Mo (OD674)

Figure 2:
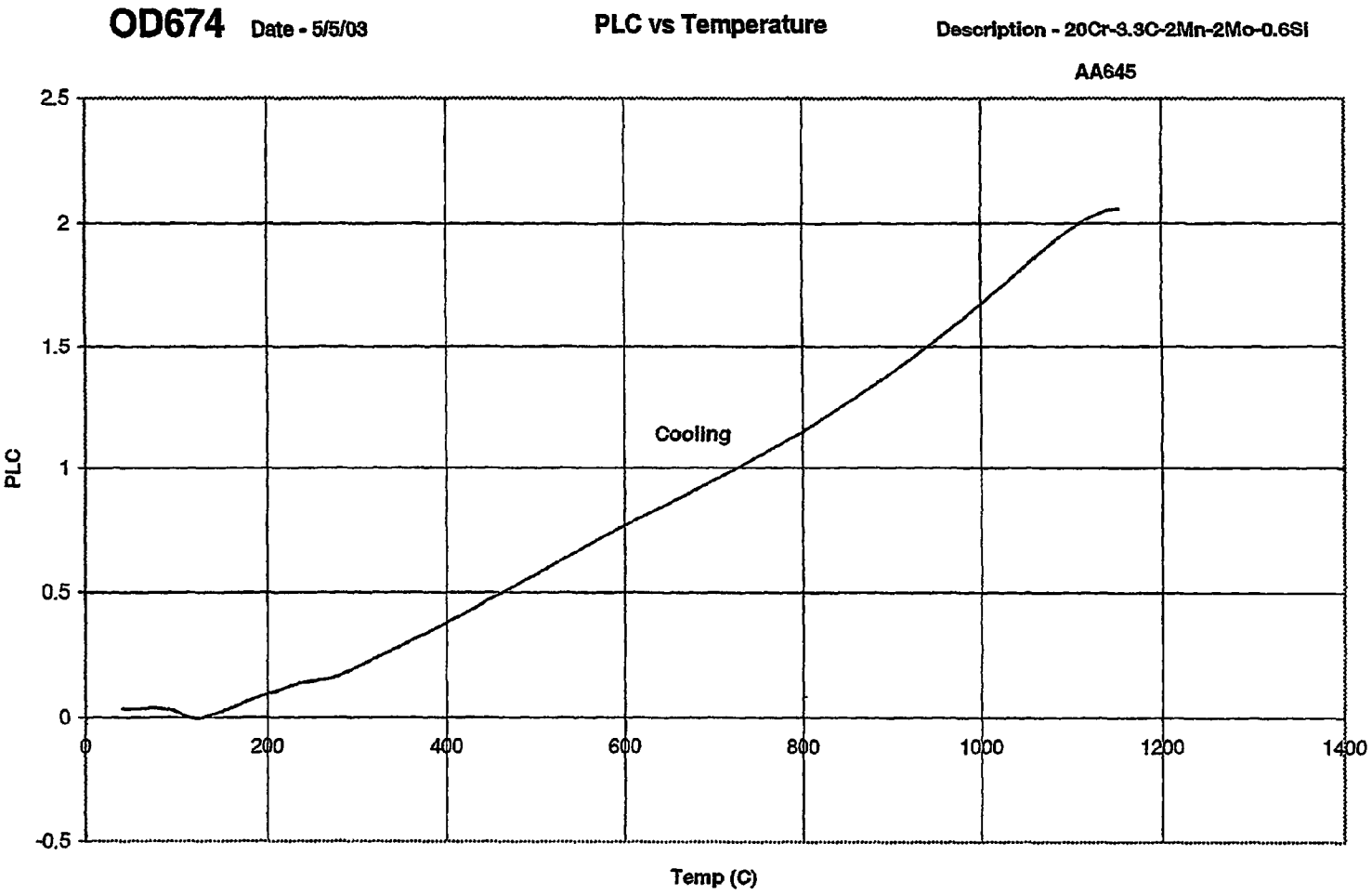
FIG. 2 is a dilatometer curve which illustrates the contraction characteristics of the conventional white cast iron 20Cr-2Mo-2Mn alloy during furnace cooling from 1150° C.

The contraction characteristics of the conventional white cast iron 20Cr-2Mo-2Mn alloy during furnace cooling from 1150° C. is illustrated in the dilatometer curve of FIG. 2.

The percent linear contraction (PLC) is about 2.1% on cooling through the temperature range. The observed contraction is continuous down to a temperature of about 300° C. where the discontinuity in the linear contraction curve indicates the onset of martensite formation (Ms temperature).

Final Hardness=766 HV50 due to the presence of martensite.

Ferrite Content=32% due to the presence of martensite and some retained austenite.

Metallographic examination demonstrated the presence of martensite and the absence of undesirable pearlite in the microstructure.

Base Alloy+4Mn (OD675)

Figure 3:
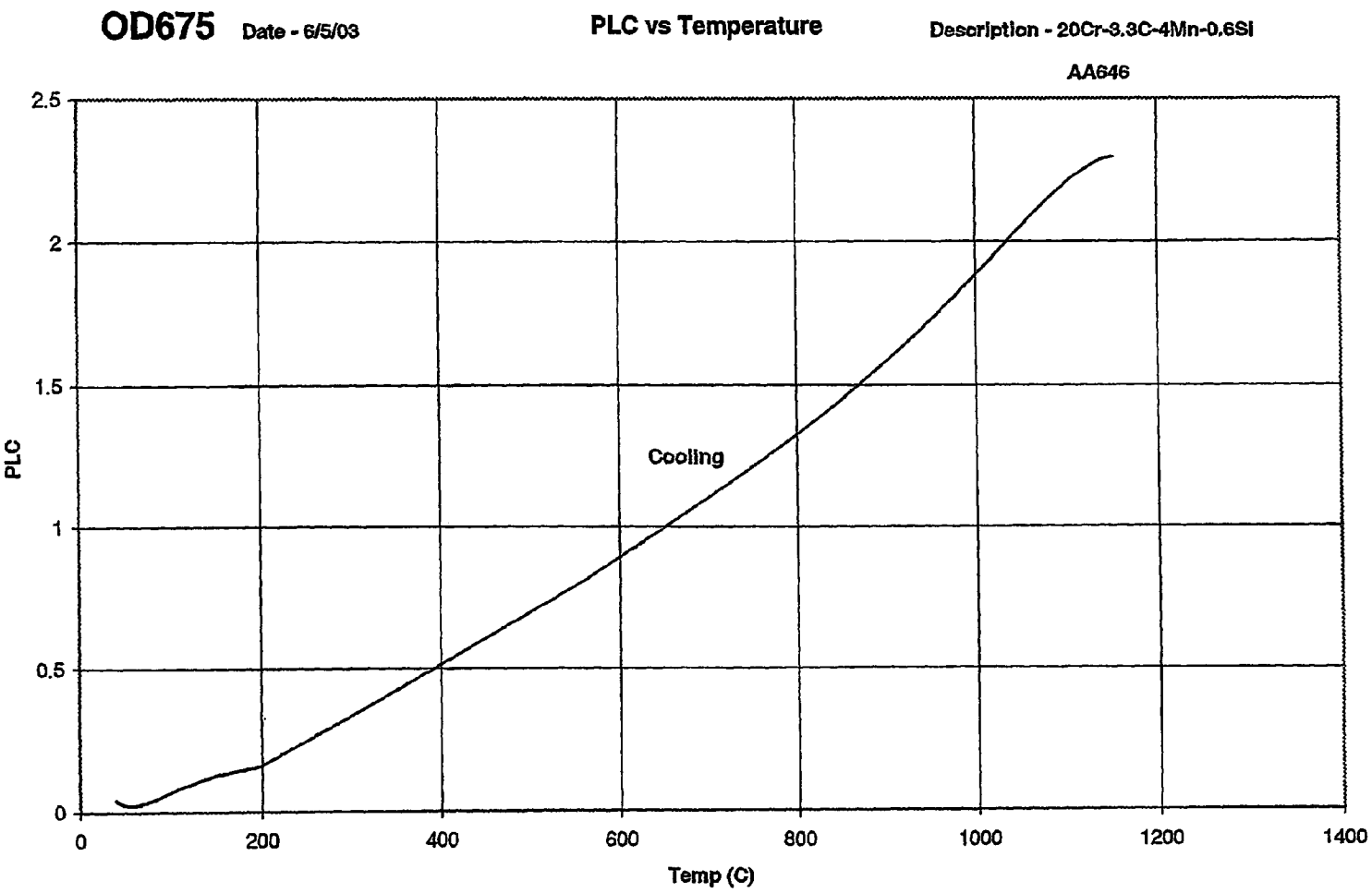
FIG. 3 is dilatometer curve which illustrates the contraction characteristics of the base alloy containing no molybdenum and 4% manganese in accordance with the present invention during furnace cooling from 1150° C.

The contraction characteristics of the base alloy containing no molybdenum and 4% manganese in accordance with the present invention during furnace cooling from 1150° C. is illustrated in the dilatometer curve of FIG. 3.

The total percent linear contraction (PLC) is about 2.3% on cooling through the temperature range. There is a discontinuity in the linear cooling curve at a temperature of about 200° C. indicating the onset of formation of martensite (Ms temperature) at that temperature.

Final Hardness=700 HV50 due to the presence of partial transformation of the austenite phase to secondary carbides and partial decomposition of the solute-depleted austenite to martensite on cooling to room temperature.

Ferrite Content=24% due to the presence of martensite and some retained austenite in the microstructure.

Metallographic examination demonstrated the absence of pearlite in the microstructure.

Base Alloy+3Mn (OD681)

Figure 4:
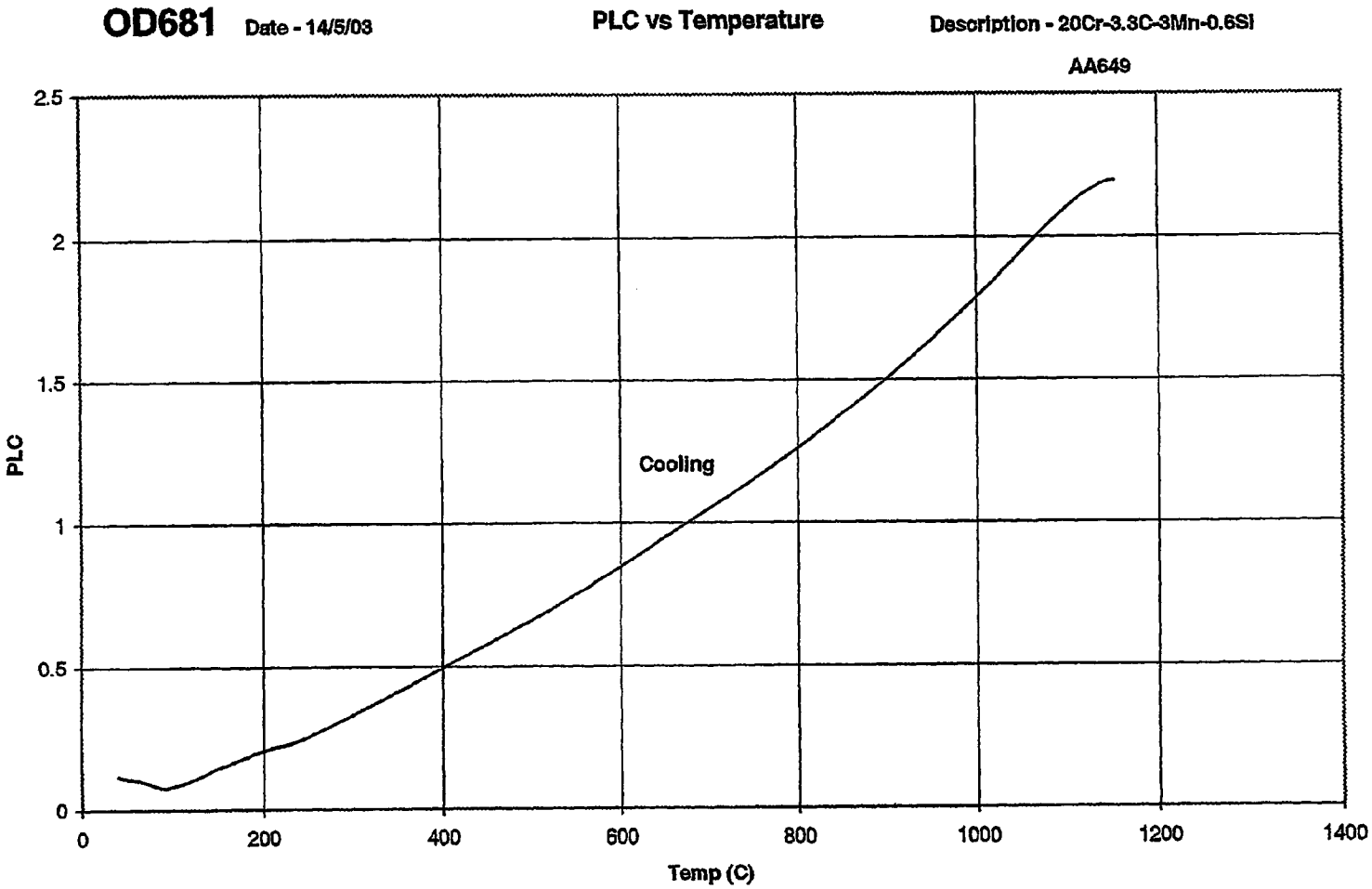
FIG. 4 is a dilatometer curve which illustrates the contraction characteristics of the base alloy containing no molybdenum and 3% manganese in accordance with the present invention during furnace cooling from 1150° C.

The contraction characteristics of the base alloy containing no molybdenum and 3% manganese in accordance with the present invention during furnace cooling from 1150° C. is illustrated in the dilatometer curve of FIG. 4.

The total percent linear contraction (PLC) is about 2.0% on cooling through the temperature range. There is a discontinuity in the linear cooling curve at a temperature of about 230° C. indicating the onset of decomposition of the retained austenite to martensite (Ms temperature) as that temperature.

Final Hardness=719 HV50 due to the presence of martensite.

Ferrite Content=33% due to the presence of martensite and some retained austenite in the microstructure.

Metallographic examination demonstrated the presence of a trace amount of undesirable pearlite in a ferrous matrix that is otherwise solute-depleted austenite that is partially transformed to martensite.

In summary, the above results for simulated as-cast samples indicate that the Base alloy+4Mn (OD675) and the Base alloy+4Mn (OD681) in accordance with the present invention had comparable performance to the conventional white cast iron 20Cr-2Mo-2Mn alloy (OD674) and considerably better performance than the Base alloy (OD676), ie with no Mn and no Mo.

As indicated above, the above-described experimental program involving the formation of rapidly chilled pin samples and heating the samples to 1150° C. and thereafter cooling the samples in the dilatometer simulates the cooling of white cast iron alloys in a sand mould after solidification.

In practice, such castings are finally hardened by heat treatment, typically by holding at 950-970° C. for a period of time and air cooling to room temperature.

In order to investigate the impact of heat treatment on the above-tested range of white cast iron alloys, pin samples of each alloy prepared as described above were heat treated at 960° C. for 4 hours and thereafter allowed to cool to room temperature.

A summary of the metallographic, hardness, and ferrite test results for four of the alloys (OD674, OD676, OD681, and OD675) is set out in Table 2 below.

TABLE 2

Summary of Test Results

| Alloy (Wt %) | Test No | Hardness (HV 50) | Ferrite (%) | Microstructure |
|---|---|---|---|---|
| Base alloy + 2Mn + 2Mo | OD674 | 857 | 32 | No Pearlite |
| Base alloy | OD676 | 371 | 52 | Pearlite |
| Base alloy + 3Mn | OD681 | 779 | 35 | Trace amount of pearlite |
| Base alloy + 4Mn | OD675 | 807 | 33 | No Pearlite |

It is evident from Table 2 that the heat treated Base alloy+4Mn (OD675) and Base alloy+4Mn (OD681) in accordance with the present invention had comparable performance to the conventional heat treated white cast iron 20Cr-2Mo alloy (OD674) and considerably better performance than the Base alloy (OD676), ie with no Mn and no Mo.

In a further series of test work a number of white cast iron alloys containing systematic variations in chromium, molybdenum and manganese levels from a base alloy composition (Fe-20Cr-3.3C-0.6Si (wt %)) were manufactured in an electric arc melting furnace under an inert atmosphere. The alloys were then processed as described below and the resultant samples were evaluated by hardness testing, ferrite content testing, dilatometry testing, and metallographic examination The samples were processed as follows.

(a) simulated casting in sand mould—heating to 1150° C. in a dilatometer furnace under an inert atmosphere at a rate of 3° C. per minute, holding at temperature for 2 hours to achieve equilibrium, and furnace cooling to ambient temperature; and (b) heat treatment of the simulated castings—heating to 960° C. in a dilatometer furnace under an inert atmosphere at a rate of 3° C. per minute, holding at temperature for 4 hours, and air cooling to ambient temperature to simulate the microstructure after heat treatment.

A summary of the metallographic, hardness, and ferrite test results for each alloy is set out in Tables 3 and 4 below.

TABLE 3

Summary of Test Results Simulated Castings

| Alloy (Wt %) | Test No | Hardness (HV 50) | Ferrite (%) | Microstructure |
|---|---|---|---|---|
| Base alloy + 5Mn | OD744 | 666 | 17 | No Pearlite |
| Base alloy + 6Mn | OD745 | 574 | 8.4 | No Pearlite |
| Base alloy + 7Mn | OD759 | 645 | 9.6 | No Pearlite |
| Base alloy + 8Mn | OD749 | 536 | 2.5 | No Pearlite |

TABLE 4

Summary of Test Results—Heat Treated Samples

| Alloy (Wt %) | Test No | Hardness (HV 50) | Ferrite (%) | Microstructure |
|---|---|---|---|---|
| Base alloy + 5Mn | OD744 | 727 | 27 | No Pearlite |
| Base alloy + 6Mn | OD745 | 629 | 10 | No Pearlite |
| Base alloy + 7Mn | OD759 | 622 | 13.6 | No Pearlite |
| Base alloy + 8Mn | OD749 | 557 | 3.8 | No Pearlite |

The microstructural and dilatometry evaluations of the above samples indicated that the amount of martensite in the matrix of each sample decreased with increasing manganese concentration to the point that at high manganese concentrations (13%) there was no martensite and the matrix comprised retained austenite.

The test data in Table 4 demonstrates that manganese levels above 7 weight % stabilises the softer austenite phase and suppresses the transformation to the harder martensite phase. Consequently, manganese contents greater than 7 weight % adversely affect the final hardness of these wear resistant alloys.

Many modifications may be made to the present invention as described above without departing from the spirit and scope of the present invention.

The invention claimed is:

1. A casting of a white cast iron alloy that comprises:
20 to 23 wt. % chromium;
3.3 to 6 wt. % carbon;
greater than 4 up to 7 wt. % manganese;
up to 1.5 wt. % silicon; and
the balance iron; and
having a microstructure comprising martensite, retained austenite and less than 2 vol. % pearlite and includes $M_7C_3$ carbides, where "M" is a metal and "C" is carbon.

2. The casting of claim 1, wherein the casting comprises greater than 4 up to 5.5 wt % manganese.

3. The casting of claim 1, wherein the casting is free of nickel and molybdenum.

4. The casting of claim 1, wherein the casting has a hardness of 700 HV 50.

5. The casting of claim 1, wherein the casting is free of pearlite.

6. A hardened casting of a white cast iron alloy, hardened at 950° C. to 1000° C. for at least 4 hours, comprising:
20 to 23 wt. % chromium;
3.3 to 6 wt. % carbon;
greater than 4 up to 7 wt. % manganese;
up to 1.5 wt. % silicon; and
the balance iron; and
having a microstructure comprising martensite, retained austenite and less than 2 vol. % pearlite and includes $M_7C_3$ carbides, where "M" is a metal and "C" is carbon.

7. The hardened casting of claim 6, wherein the casting comprises greater than 4 up to 5.5 wt % manganese.

8. The hardened casting of claim 6, wherein the casting is free of nickel and molybdenum.

9. The hardened casting of claim 6, wherein the casting has a hardness of 700 HV 50.

10. The hardened casting of claim 6, wherein the casting is free of pearlite.

11. The hardened casting of claim 6, wherein the casting has a hardness of from 700-719 HV 50.

12. The hardened casting of claim 6, wherein the microstructure of the hardened casting further comprises 32.4 to 60 vol. % eutectic carbides and primary carbides dispersed in a ferrous matrix that comprises martensite.

13. A method for producing a hardened white cast iron alloy casting, comprising:
a) pouring a molten melt of a white cast iron alloy to form a casting;
b) cooling the casting to room temperature; and
c) hardening the casting by heating the casting to a temperature of from 950° C. to 1000° C. and holding the casting at 950° C. to 1000° C. for at least 4 hours to destabilize austenite to form the hardened white cast iron alloy casting composed of:
20 to 23 wt. % chromium;
3.3 to 6 wt. % carbon;
greater than 4 up to 7 wt. % manganese;
up to 1.5 wt. % silicon; and
the balance iron; and
having a microstructure comprising martensite, retained austenite and less than 2 vol. % pearlite and includes $M_7C_3$ carbides, where "M" is a metal and "C" is carbon.

14. The method of claim 13, wherein the white cast iron alloy is free of nickel and molybdenum.

15. The method of claim 13, wherein the white cast iron alloy comprises greater than 4 up to 5.5 wt % manganese.

16. The method of claim 13, wherein the microstructure of the hardened white cast iron alloy casting further comprises 32.4 to 60 vol. % eutectic carbides and primary carbides dispersed in a ferrous matrix that comprises martensite.

17. The method of claim 13, wherein the hardened white cast iron alloy casting has a hardness of 700 HV 50.

18. The method of claim 13, wherein the casting is free of pearlite.

19. The method of claim 13, wherein the casting has a hardness of from 700-719 HV 50.

* * * * *